US011306478B2

(12) United States Patent
Duan et al.

(10) Patent No.: US 11,306,478 B2
(45) Date of Patent: Apr. 19, 2022

(54) INTEGRALLY ASSEMBLED HIDDEN BEAM HOLLOW TWO-WAY FLOOR SYSTEM AND METHOD FOR ASSEMBLING THE SAME

(71) Applicant: CHANG'AN UNIVERSITY, Xi'an (CN)

(72) Inventors: Liusheng Duan, Xi'an (CN); Tianhua Zhou, Xi'an (CN)

(73) Assignee: CHANG'AN UNIVERSITY, Xi'an (CN)

( * ) Notice: Subject to any disclaimer, the term of this patent is extended or adjusted under 35 U.S.C. 154(b) by 0 days.

(21) Appl. No.: 16/981,271

(22) PCT Filed: Dec. 29, 2018

(86) PCT No.: PCT/CN2018/125152
§ 371 (c)(1),
(2) Date: Sep. 15, 2020

(87) PCT Pub. No.: WO2019/200969
PCT Pub. Date: Oct. 24, 2019

(65) Prior Publication Data

US 2021/0040740 A1 Feb. 11, 2021

(30) Foreign Application Priority Data

Apr. 20, 2018 (CN) ..... 201810362012.7

(51) Int. Cl.
*E04B 5/04* (2006.01)
*E04B 5/02* (2006.01)
*E04B 5/10* (2006.01)

(52) U.S. Cl.
CPC ..... *E04B 5/043* (2013.01); *E04B 5/023* (2013.01); *E04B 5/10* (2013.01)

(58) Field of Classification Search
CPC . E04B 5/043; E04B 5/023; E04B 5/10; E04B 5/266; E04B 5/265
(Continued)

(56) References Cited

U.S. PATENT DOCUMENTS 1,912,429 A * 6/1933 Burgess ..... E01C 5/005 404/40
2,235,356 A * 3/1941 Byers ..... H02G 9/025 52/582.1
(Continued)

FOREIGN PATENT DOCUMENTS

CH 138799 A * 3/1930 ..... E04B 5/265
CH 144514 A * 1/1931 ..... E04B 5/266
(Continued)

*Primary Examiner* — Adriana Figueroa
(74) *Attorney, Agent, or Firm* — W&G Law Group

(57) ABSTRACT

An integrally assembled hidden beam hollow two-way floor system includes precast slabs (1), honeycomb steel beams (3), and cast-in-place concrete (4). A plurality of compartments (12) arranged in a matrix is integrally provided on one surface of each of the precast slabs (1), and connecting grooves (14) are provided at a periphery of another surface of the precast slab (1) is provided with connecting grooves (14). Prepared bolt holes (13) penetrating through the precast slab (1) are provided in the connecting grooves (14). The honeycomb steel beam (3) serves as a primary beam or a secondary beam of a steel structure of the floor system. A surface of the precast slab (1) provided with no compartments is lapped and fixed between the secondary beams or between the primary beam and the secondary beam, and adjacent precast slabs (1) are connected and fixed by a U-shaped hoop (2) passing through the prepared bolt hole (13) to form a seam. The cast-in-place concrete (4) includes a surface layer cast onto the compartments (12) and a cast-in-place concrete ribs (41) cast between the compartments (12) of adjacent precast slabs (1) and between the
(Continued)

compartment (12) and the primary beam and the secondary beam, the surface layer and the cast-in-place concrete ribs (41) being integrated. An assembly method for the integrally assembled hidden beam hollow two-way floor system is further provided. A method for assembling an integrally assembled hidden beam hollow two-way floor system is provided. The floor system and method for assembling the same achieve similar force performances in two directions, reliable connection between the floor slab and peripheral members, elimination of a risk of cracking of slab seams, and improved assembly efficiency.

8 Claims, 2 Drawing Sheets

(58) Field of Classification Search
USPC ..... 52/259, 602
See application file for complete search history.

(56) References Cited

U.S. PATENT DOCUMENTS 4,545,701 A * 10/1985 Tsuzuki ..... E21D 11/083 138/159
6,243,994 B1 * 6/2001 Bernini ..... E02D 29/045 14/26
6,442,908 B1 * 9/2002 Naccarato ..... E04B 5/43 52/236.8
6,474,029 B1 * 11/2002 Cook ..... E01C 5/20 52/223.7
8,973,318 B2 * 3/2015 Hammond ..... E04C 2/38 52/223.7
10,689,839 B2 * 6/2020 Wheatley ..... E04B 1/215
2018/0127968 A1 * 5/2018 Ziehl ..... E04B 5/023
2018/0298624 A1 * 10/2018 Laurindo ..... E04G 17/001

FOREIGN PATENT DOCUMENTS

CH 148397 A * 7/1931 ..... E04B 5/29
CH 160982 A * 4/1933 ..... E04B 5/265
CH 163208 A * 8/1933 ..... E04B 5/265
CH 215876 A * 7/1941 ..... E04B 5/265
CN 2663553 Y * 12/2004
CN 205024907 U 2/2016
CN 206233433 U 6/2017
CN 107700667 A 2/2018
CN 108590005 A 9/2018
DE 632236 C * 7/1936 ..... E04B 5/266
DE 813589 C * 9/1951 ..... E04B 5/29
DE 3319745 A1 * 12/1984 ..... E04C 3/294
EP 1227198 A2 * 7/2002 ..... E04C 3/293
EP 1528170 A1 * 5/2005 ..... E04F 15/20
EP 3517698 A1 * 7/2019 ..... B28B 1/084
FR 743691 A * 4/1933 ..... E04B 5/043
FR 1155818 A * 5/1958 ..... E04C 5/0656
JP 2005325579 A 11/2005

* cited by examiner

INTEGRALLY ASSEMBLED HIDDEN BEAM HOLLOW TWO-WAY FLOOR SYSTEM AND METHOD FOR ASSEMBLING THE SAME

TECHNICAL FIELD

The present disclosure relates to a civil engineering and an assembly structure, and in particular, to an integrally assembled hidden beam hollow two-way floor system and a method for assembling the same.

BACKGROUND

A steel-structure floor system is mostly a beam-slab type, which occupies a certain layer height, resulting in waste of materials. And a steel beam has a large exposed area, thereby increasing a cost in fire prevention and corrosion prevention. A bottom slab of a floor deck is a profiled steel plate having an uneven bottom surface, and thus a furred ceiling will be required, thereby increasing a process and a cost thereof.

The existing assembled hollow floor systems are mostly employed in concrete frames, and are rarely used in steel structures, and main problems thereof includes a connection between a precast slab and a steel beam and a connection between slab seams of the precast slabs. If the precast slab is only placed at a flange of the steel beam in the steel structure, it will easily fall off during an earthquake and thus it is not safe. If the precast slab is embedded in and welded to the steel beam, too much welding operations on site will be performed, resulting in a low construction efficiency and an unreliable quality. The precast slab should not have a large size, otherwise it will be difficult to transport and hoist the precast slab and cracking will easily occur. The cracking of a seam between precast slabs easily occurs, and improper handling will lead to water leakage and ash drop, which will seriously affect its usage. The precast slab is generally a one-way slab, which has quite different force performances in two directions, and thus it cannot take full advantage of tensile capacity of the distributed rebars, resulting in waste of materials.

SUMMARY

In view of the problems illustrated in the prior art, the present disclosure provides an integrally assembled hidden beam hollow two-way floor system and method for assembling the same. The floor system achieves similar force performances in two directions, reliable connection between the floor slab and peripheral members, elimination of a risk of cracking of slab seams, and improved assembly efficiency.

The present disclosure is implemented through technical solutions in the following. An integrally assembled hidden beam hollow two-way floor system includes precast slabs, honeycomb steel beams, and cast-in-place concrete. An integrally assembled hidden beam hollow two-way floor system, including: precast slabs, honeycomb steel beams, and cast-in-place concrete. A plurality of compartments arranged in a matrix is integrally provided on one, connecting grooves are provided at a periphery of another surface of the precast slab, and prepared bolt holes penetrating through the precast slab are provided in the connecting grooves. The honeycomb steel beams serve as primary beams and secondary beams of a steel structure of the floor system. A surface of the precast slab provided no compartment is lapped and fixed between the secondary beams or between one of the primary beams and one of the secondary beams, and adjacent precast slabs of the precast slabs are connected and fixed by a U-shaped hoop passing through one of the prepared bolt holes to form a seam. The cast-in-place concrete includes a surface layer cast onto the plurality of compartments and a cast-in-place concrete rib. The cast-in-place concrete rib is cast between compartments of adjacent precast slabs of the precast slabs, and between the plurality of compartments and the primary beams or the secondary beams. The surface layer and the cast-in-place concrete ribs are formed into one piece.

Preferably, the plurality of compartments arranged in the matrix are defined by and separated from each other by protruding slab ribs.

Further, a thickness of an edge of each of the precast dabs is smaller than a height of each of the slab ribs, and a side of one of the slab ribs close to the edge of the precast slab is a slop for naturally transition.

Preferably, the integrally assembled hidden beam hollow two-way floor system further includes honeycomb holes penetrating through the honeycomb steel beams, or hogging moment noon rebars fixed to upper flanges of the honeycomb steel beams.

Preferably, when the surface of the precast slab provided with no compartment is lapped between the secondary beams or between the one of the primary beams and the one of the secondary beams, and is fixed to the secondary beams or to the one of the primary beams and the one of the secondary beams through bolts.

Further, a honeycomb web of one of the primary beams connected to one of the precast slabs or one of the secondary beams connected to one of the precast slabs is provided with a reinforcing slab parallel to a lower flange, and one of the precast slabs is connected and fixed between the lower flange and the reinforcing slab through one of the bolts that penetrates the one of the precast slabs.

Preferably, the U-shaped hoop passes through the prepared bolt hole from bottom to top and cooperates with a connecting slab and a nut in such a manner that the adjacent precast slabs are connected and fixed to form a seam.

A method for assembling an integrally assembled hidden beam hollow two-way floor system, includes:

step 1: molding each of precast slabs once through an inverted casting method, the precast slab being hollow and having two-way rib compartments, where a formwork is prepared based on an outer contour of the precast slab, then a plurality of compartments are fixed in a matrix, two-way forced rebars are tied, prepared bolt holes are fixed, concrete is cast and cured in a shape, connecting grooves are prepared at a periphery of a surface of the precast slab provided with no compartments, and then the precast slab is acquired by turning over after the curing;

step 2: processing and assembling a steel structure of a floor system, where honeycomb steel beams of the steel structure are manufactured in a factory, the prepared bolt holes at lower flanges are used to manufacture a U-shaped hoop, and the honeycomb steel beams are transported to a site to serve as primary beams, or secondary beams, or primary beams and secondary beams;

step 3: assembling the precast slabs, where each of the precast slabs is hanged to a position between the secondary beams manufactured by the honeycomb steel beams or between one of the primary beams and one of the secondary beams formed by the honeycomb steel beams, the precast slab is first placed at one of the lower flanges at a connection position, each of ends of two precast slabs of the precast slabs is supported by the one of the lower flange and connected to the one of the lower flange through a bolt, and side ends of the two precast slabs at a seam are connected to each other through a U-shaped hoop; and step 4: casting concrete, where debris is first cleaned, a surface of each of the precast slabs is soaked with water, then cast-in-place concrete is casted to form a cast-in-place concrete rib and a surface layer, and then curing and molding are performed to complete the assembling for the integrally assembled hidden beam hollow two-way floor system.

Further, slab seams of the precast slabs and the bolt hole seams are sealed with epoxy resin mortar.

Further, the method further includes, between the step 3 and the step 4, laying water pipelines and electricity pipelines in an empty space outside slab ribs and arranged between two precast slabs and in honeycombs of honeycomb webs; and then tying hogging moment zoon rebars, the hogging moment zoon rebars passing through honeycomb holes of the honeycomb steel beams or being fixed to upper surfaces of upper flanges.

Compared with the prior art, the present disclosure has the following beneficial technical effects.

The floor system according to the present disclosure allows the floor system to be subjected to forces in two directions by lap fixation and seam fixation, thereby making the force performances in two direction similar to each other, increasing a material utilization rate of the stretched rebar. The honeycomb steel beam and the precast slab are manufactured in a factory, an assembly efficiency of the steel structure is greatly improved, thereby basically reducing the on-site welding work to zero. With combination of the pre-supported slab and the cast-in-place concrete, the steel beam is wrapped by making full use of the concrete, thereby decreasing an exposed area of the steel structure, decreasing the cost in fire prevention and corrosion prevention, and decreasing the overall cost. The precast slab is modularized and unitized in size, which facilitates industrial production of construction. It can be prefabricated in the factory and transported to the site, or it can be manufactured nearby the site. With the compartment, a weight of the floor system can be decreased, and temperature insulation and sound insulation effects of the floor slab can be improved, thereby facilitating construction and transportation of the precast slabs, and facilitating positioning of various pipelines and the hogging moment noon rebars of the floor system. The amount of usage of steel of the steel beam web of the honeycomb beam can be effectively decrease, thereby decreasing a weight of the structure and decreasing the cost, without significant decrease of the bearing performance of the steel beam. In addition, since the web of the honeycomb steel beam has prepared holes, it is convenient for the rebar or pipeline to pass through, which facilitates construction on site. The honeycomb holes of the honeycomb steel beam and cast-in-place concrete can improve cooperation therebetween through embedding, mechanical engagement and adhesive friction, thereby strengthening the integrity of the floor system.

Further, the integrity of the floor system is improved by the U-shaped hoop bolt connection and the cast-in-place concrete, thereby satisfying the structural safety and use requirements.

IN THE FIGURES

Figure 1:
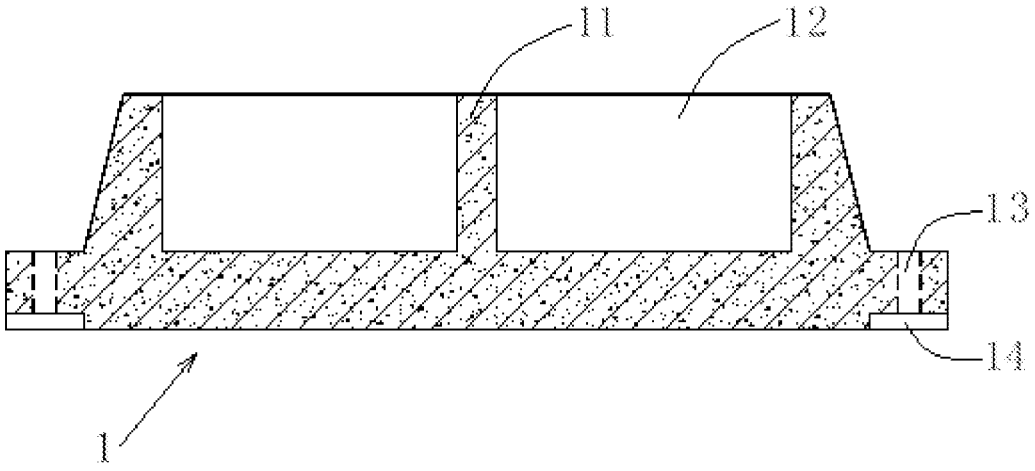
FIG. 1 is a schematic cross-sectional view of a precast slab according to an embodiment of the present disclosure.

1: precast slab, 11: slab rib, 12: compartment, 13: prepared bolt hole, 14: connecting groove; 2: U-shaped hoop, 21: hoop body, 22: connecting slab, 23: nut; 3: honeycomb steel beam, 31: lower flange, 32: honeycomb web, 33: upper flange; 4: cast-in-place concrete, 41: cast-in-place concrete rib; 43: hogging moment-rebars; 5: bolt; 6: reinforcing slab; 7: water pipelines; 8: electricity pipelines.

DESCRIPTION OF EMBODIMENTS

The present disclosure will be further described in details in the following with reference to specific embodiments, which are illustrations and not limitations of the present disclosure.

An embodiment of the present disclosure provides an integrally assembled hidden beam hollow two-way floor system, which includes hollow precast slabs 1 with two-way rib compartments, a honeycomb steel beam 3 used as a primary beam or a secondary beam, a U-shaped hoop 2 that is connected by a bolt 5, and cast-in-place concrete 4, Multiple compartments 12 arranged in a matrix is integrally provided on a surface the precast slab 1, and connecting grooves 14 are provided at a periphery of another surface of the precast slab 1. Prepared bolt holes 13 penetrating through the precast slab 1 are provided in the connecting grooves 14. The honeycomb steel beams 3 serve as primary beams and secondary beams of a steel structure of the floor system. A surface of the precast slab 1 provided with no compartment is lapped and fixed between secondary beams or between the primary beam and the secondary beam, and adjacent precast slabs 1 are connected and fixed by a U-shaped hoop 2 passing through the prepared bolt hole 13 to form a seam. The cast-in-place concrete 4 includes a surface layer cast onto the compartments 12 and a cast-in-place concrete rib cast between the compartments 12 of adjacent precast slabs 1 and between the compartment 12 and one of the primary beam and the secondary beam, and the surface layer and the cast-in-place concrete ribs 41 are formed into one piece.

Figure 3:
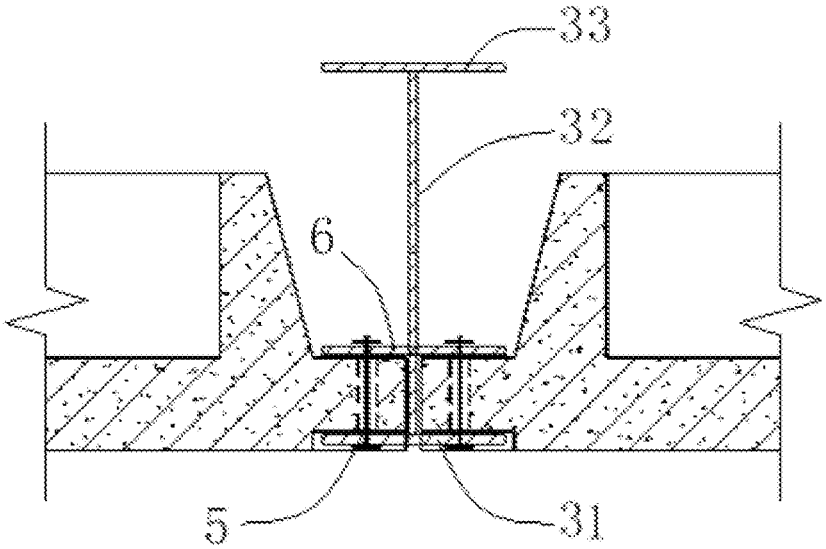
FIG. 3 is a schematic diagram of a connection node of a precast slab according to an embodiment of the present disclosure.

The compartments 12 arranged in the matrix are defined by and separated from each other by protruding slab ribs 11, A thickness of an edge of the precast slab 1 is smaller than a height of the slab rib 11, and a side of the slab rib 11 close to the edge of the precast slab 1 is a slop for natural transition, thereby avoiding stress concentration. Preferably, as shown in FIG. 3, the honeycomb beams are manufactured in a factory. In order to ensure connection between the precast slab 1 and the honeycomb steel beam 3, a reinforcing slab 6 can be welded at a position where the primary beam and the secondary beam have a same elevation, and round bolt holes can be provided. The process of welding and hole opening can be completed in the factory.

The integrally assembled hidden beam hollow two-way floor system further includes a honeycomb hole penetrating through the honeycomb steel beam 3, or a hogging moment rebars 43 fixed to an upper flange 33 of the honeycomb steel beam 3. When the surface of the precast slab 1 provided with no compartment is lapped between the secondary beams or between the primary beams and the secondary beams, the surface of the precast slab 1 provided with no compartment is fixed through bolts 5. The honeycomb web 32 of the primary beam or the secondary beam connected to the precast slab 1 is provided with a reinforcing slab 6 parallel to a lower flange 31, and the precast slab 1 is connected and fixed between the lower flange 31 and the reinforcing slab 6 by the bolt 5 that penetrates the precast slab 1. The U-shaped hoop 2 passes through the prepared bolt hole 13 from bottom to top and cooperates with a connecting slab 22 and a nut 23 in such a manner that the adjacent precast slabs are connected and fixed to form a seam.

A method for assembling an integrally assembled hidden beam hollow two-way floor system includes following steps.

At step 1, precast slabs 1 that are hollow and have two-way rib compartments are fabricated for a special purpose. As shown in FIG. 1, precast slabs 1 are mold through an inverted casting method once. A formwork is prepared bases on an outer contour of the precast slab 1, then multiple compartments 12 are fixed in a matrix, two-way forced rebars are tied, prepared bolt holes 13 are fixed, concrete is cast and cured in a shape, connecting grooves 14 are prepared at peripheries of a surface of the precast slab 1 provided with no compartment to ensure that a whole slab bottom is a big flat surface after being connected by bolts 5. Then the precast slab 1 is acquired by turning over after the curing.

At step 2, a steel structure of the floor system is processed and assembled. At this step, honeycomb steel beams 3 of the steel structure are manufactured in a factory, the prepared bolt holes 13 at lower flanges 31 are used to manufacture a U-shaped hoop 2, and the honeycomb steel beams 3 are transported to a site to serve as primary beams, or secondary beams, or primary beams and secondary beams.

Figure 2:
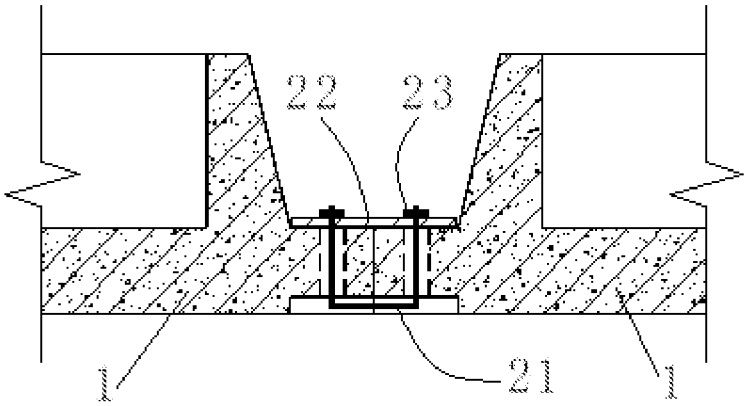
FIG. 2 is a schematic diagram of a seam node of a precast slab according to an embodiment of the present disclosure.

At step 3, the precast slab 1 is assembled. The precast slab 1 is transported to the site and hanged to a position between the secondary beams or between the primary beam and the secondary beam formed by honeycomb steel beams 3. As shown in FIG. 3, the precast slab 1 is first placed at the lower flange 31 at a connection position, each of ends of two precast slabs 1 is supported by the lower flange and connected to the lower flange 31 through a bolt 5. Preferably, when the bolt 5 is tightened, the bolt 5 can cooperate with the reinforcing slab 6 that is fixed to the honeycomb web 32. As shown in FIG. 2, side ends of the two precast slabs 1 at a seam are connected to each other through a U-shaped hoop 2. Specifically, a hoop body 21 penetrates a connecting slab 22 and then is connected to a nut 23, thereby effectively avoiding falling off and forming an integral slab which is subjected forces in two directions. Slab seams are sealed with epoxy resin mortar to prevent slurry leakage when casting concrete, and a same process is performed for the bolt hole.

At step 4, water pipelines 7 and electricity pipelines 8 are laid in an empty space outside slab ribs and arranged between two precast slabs 1 and in honeycombs of honeycomb webs 32, and then hogging moment rebars 43 are tied. The hogging moment rebars 43 can pass through honeycomb holes of the honeycomb steel beams 3 or can be fixed to upper surfaces of upper flanges 33, to ensure that a position of the hogging moment rebars 43 satisfies a design requirement.

Figure 4:
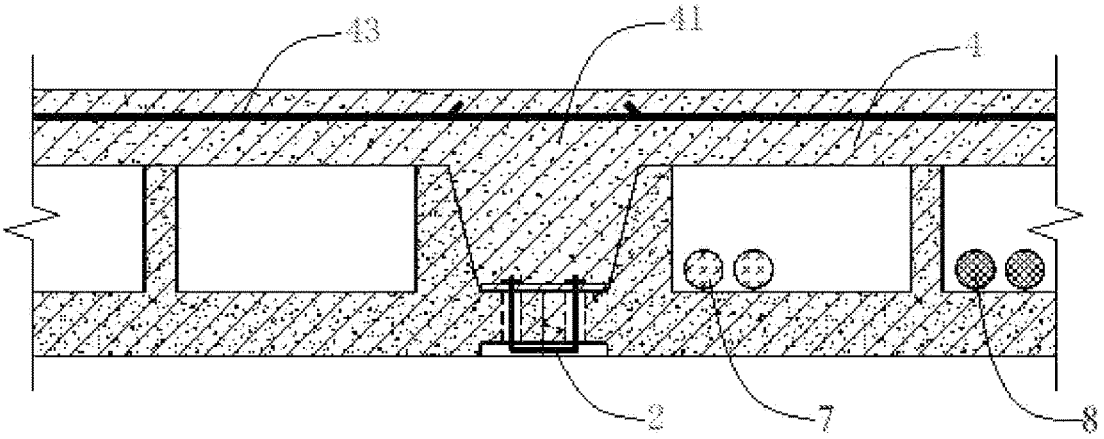
FIG. 4 is a schematic diagram illustrating an overall assembly at a seam position according to an embodiment of the present disclosure.
Figure 5:
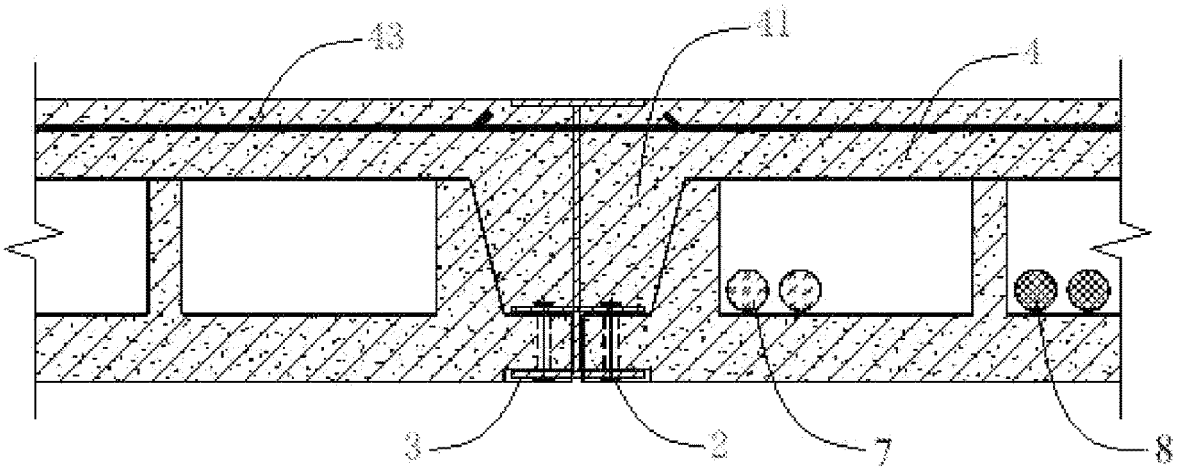
FIG. 5 is a schematic diagram illustrating an overall assembly at a connection position according to an embodiment of the present disclosure.

At step 5, as shown in FIG. 4 and FIG. 5, concrete 4 is casted. At this step, debris is first cleaned, then the surface of the precast slab 1 is soaked with water, cast-in-place concrete 4 is casted to form a cast-in-place concrete rib 41 and a surface layer, then curing and molding are performed to complete the assembling of the integrally assembled hidden beam hollow two-way floor system. An elevation of a cast surface can be aligned with an upper surface of the upper flange 33 or slightly higher than the upper surface of the flange upper flange 33 of the steel beam.

What is claimed is:

1. An integrally assembled hidden beam hollow two-way floor system, comprising:

precast slabs, wherein a plurality of compartments arranged in a matrix are integrally provided on one surface of each of the precast slabs, connecting grooves are provided at a periphery of another surface of each of the precast slabs, and prepared bolt holes penetrating through each of the precast slabs are provided in the connecting grooves;

honeycomb steel beams serving as primary beams and secondary beams of a steel structure of the floor system, a surface of each of the precast slabs provided with no compartment is lapped and fixed between the secondary beams or between one of the primary beams and one of the secondary beams, and adjacent precast slabs of the precast slabs are connected and fixed by a U-shaped hoop passing through one of the prepared bolt holes to form a seam; and cast-in-place concrete comprising a surface layer cast onto the plurality of compartments and a cast-in-place concrete rib, wherein the cast-in-place concrete rib is cast between compartments of adjacent precast slabs of the precast slabs and between the plurality of compartments and the primary beams or the secondary beams, and the surface layer and the cast-in-place concrete rib are formed into one piece;

wherein the U-shaped hoop passes through the prepared bolt hole from bottom to top and cooperates with a connecting plate and a nut in such a manner that the adjacent precast slabs are connected and fixed to form a seam.

2. The integrally assembled hidden beam hollow two-way floor system according to claim 1, wherein the plurality of compartments arranged in the matrix are defined by and separated from each other by protruding slab ribs.

3. The integrally assembled hidden beam hollow two-way floor system according to claim 2, wherein a thickness of an edge of each of the precast slabs is smaller than a height of each of the slab ribs, and a side of one of the slab ribs close to the edge of the precast slab is a slop for natural transition.

4. The integrally assembled hidden beam hollow two-way floor system according to claim 1, further comprising:

honeycomb holes penetrating through the honeycomb steel beams; or hogging moment rebars fixed to upper flanges of the honeycomb steel beams.

5. The integrally assembled hidden beam hollow two-way floor system according to claim 1, wherein when the surface of the precast slab provided with no compartment is lapped between the secondary beams or between the one of the primary beams and the one of the secondary beams, and is fixed to the secondary beams or to the one of the primary beams and the one of the secondary beams through bolts.

6. The integrally assembled hidden beam hollow two-way floor system according to claim 5, wherein a honeycomb web of one of the primary beams connected to one of the precast slabs or one of the secondary beams connected to one of the precast slabs is provided with a reinforcing plate parallel to a lower flange, and one of the precast slabs is connected and fixed between the lower flange and the reinforcing plate through one of the bolts (5) that penetrates the one of the precast slabs.

7. A method for assembling an integrally assembled hidden beam hollow two-way floor system, comprising:

step 1: molding each of precast slabs once through an inverted casting method, the precast slab being hollow and having two-way rib compartments, wherein a formwork is prepared based on an outer contour of the precast slab, then a plurality of compartments are fixed in a matrix, two-way forced rebars are tied, prepared bolt holes are fixed, concrete is cast and cured in a shape, connecting grooves are prepared at a periphery of a surface of the precast slab provided with no compartment, and then the precast slab is acquired by turning over after the curing;

step 2: processing and assembling a steel structure of the floor system, wherein honeycomb steel beams of the steel structure are manufactured in a factory, the prepared bolt holes at lower flanges are used to manufacture a U-shaped hoop, and the honeycomb steel beams are transported to a site to serve as primary beams, or secondary beams, or primary beams and secondary beams;

step 3: assembling the precast slabs, wherein each of the precast slabs is hung to a position between the secondary beams manufactured by the honeycomb steel beams or between one of the primary beams and one of the secondary beams formed by the honeycomb steel beams, the precast slab is first placed at one of the lower flanges at a connection position, each end of two precast slabs of the precast slabs is supported by the one of the lower flange and connected to the one of the lower flange through a bolt, and side ends of the two precast slabs at a seam are connected to each other through a U-shaped hoop; and step 4: casting concrete, wherein debris is first cleaned, a surface of each of the precast slabs is soaked with water, then cast-in-place concrete is cast to form a cast-in-place concrete rib and a surface layer, and then curing and molding are performed to complete the assembling of the integrally assembled hidden beam hollow two-way floor system;

wherein the method further comprises, between the step 3 and the step 4;

laying water pipelines and electricity pipelines in an empty space on an outer side of slab ribs and arranged between two precast slabs and in honeycombs of honeycomb webs; and then tying hogging moment rebars, the hogging moment rebars passing through honeycomb holes of the honeycomb steel beams or being fixed to upper surfaces of upper flanges.

8. The method for assembling the integrally assembled hidden beam hollow two-way floor system according to claim 7, wherein slab seams of the precast slabs and bolt hole seams are sealed with epoxy resin mortar.

* * * * *